United States Patent [19]

Challacombe et al.

[11] Patent Number: 4,757,863

[45] Date of Patent: Jul. 19, 1988

[54] WELL CLEANING METHOD AND APPARATUS

[76] Inventors: Robert D. Challacombe, 5583 Pebble Beach La.; Scott R. Challacombe, 5841 Kingsbrier Rd.; Brad J. Challacombe, 19961 Canyon Dr., all of Yorba Linda, Calif. 92686

[21] Appl. No.: 41,972

[22] Filed: Apr. 24, 1987

[51] Int. Cl.[4] ..... E21B 43/263

[52] U.S. Cl. ..... 166/299; 166/63; 166/311; 102/275.5; 102/323

[58] Field of Search ..... 166/63, 177, 299, 311; 102/312, 317, 323, 275.2, 275.5, 275.6, 275.12

[56] References Cited

U.S. PATENT DOCUMENTS

| | | | |
|---|---|---|---|
| 2,650,539 | 9/1953 | Greene | 166/63 X |
| 2,842,055 | 7/1958 | Mason | 102/317 X |
| 3,332,349 | 7/1967 | Schwoyer et al. | 102/317 |
| 3,657,296 | 10/1962 | Silverman | 102/275.5 X |
| 3,721,297 | 3/1973 | Challacombe | 166/299 |
| 4,064,935 | 12/1977 | Mophaupt | 166/299 X |
| 4,081,031 | 3/1978 | Mophaupt | 166/299 |
| 4,537,255 | 8/1985 | Regalbuto et al. | 166/299 X |

*Primary Examiner*—George A. Suchfield
*Attorney, Agent, or Firm*—Gausewitz, Carr & Rothenberg

[57] ABSTRACT

An improved, simplified and less expensive apparatus and method for cleaning wells embodies an elongated tube of combustible material, sealed at its ends, that is ignited at one end to generate a pressure wave that travels along the length of the tube. Outwardly directed pressure generated within the well casing by the deflagration is periodically attenuated at spaced locations along the length of the tube by a plurality of spaced short, steel sleeves circumscribing the tube and secured thereto. Three such tube sections are provided, each with its spaced, short circumscribing steel sleeves and each ignited in a selected chronological and positional sequence by three individual simultaneously electrically activated detonator caps which are provided with mutually different delay times.

12 Claims, 1 Drawing Sheet

WELL CLEANING METHOD AND APPARATUS

BACKGROUND OF THE INVENTION

The present invention is an improvement on U.S. Pat. No. 3,721,297 for Method For Cleaning Wells, invented by Robert D. Challacombe, one of the inventors of the present invention. Arrangements described in the U.S. Pat. No. 3,721,297 have been used with significant and wide-spread success for many years. However, the apparatus disclosed in this patent is relatively complex and costly to manufacture. Particular molding of specific parts, assembly of various internal elements, and arrangements for initiating detonation in desired sequences require significant manufacturing time and effort and relatively complex assembly procedures. Although overall reliability has been shown to be excellent, improvement is always desired.

Government regulations concerning safety of handling and transport of explosive materials require that parts cannot be armed during shipment. Such regulations, accordingly, have required changes in the mode of assembly and handling of the prior apparatus, thus adding still further complexity and expense.

Accordingly, it is an object of the present invention to provide methods and apparatus for cleaning of wells which avoid or minimize above-mentioned problems.

SUMMARY OF THE INVENTION

In carrying out principles of the present invention in accordance with a preferred embodiment thereof, an elongated tube containing combustible material is provided with means for igniting the material to achieve deflagration that progresses along the length of the tube and generates an outwardly directed pressure. Restrictor means on the exterior of the tube attenuate the outwardly directed pressure at at least one part of the length of the tube. In a specific embodiment the restrictor means are formed by a plurality of short, longitudinally spaced, high strength sleeves circumscribing the tube to thereby produce a series of rapid, sequential series of pressure pulses at successive positions along the length of the tube. From one standpoint the arrangement provides an outwardly directed pressure wave which travels longitudinally along the length of the tube within the interior of the well casing, and the restrictor sleeves, by attenuating the pressure wave at successive positions along the length of the tube, in effect provide a microdelay in the propagation of the pressure along the tube.

According to a method embodying principles of the invention, an outwardly directed pressure wave is initiated from a point within a well casing and caused to travel longitudinally of the casing. Propagation of the pressure wave along the casing is periodically interrupted by attenuating the outwardly directed force of the pressure at areas spaced along the length of the well casing.

DETAILED DESCRIPTION OF THE INVENTION

Figure 1:
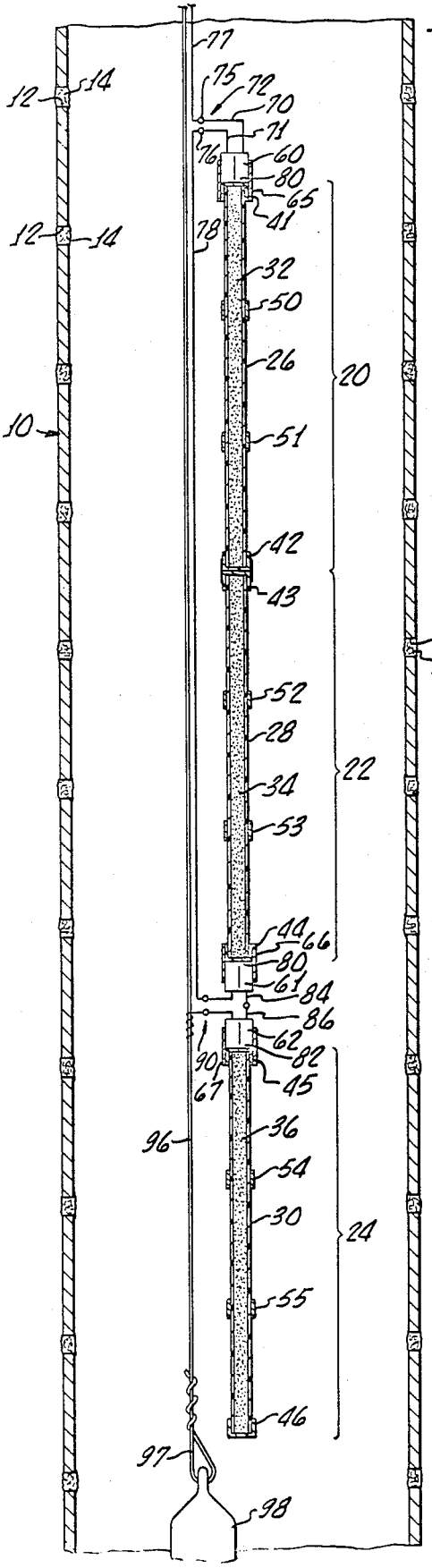
FIG. 1 is a longitudinal section of a well casing having a length of apparatus embodying principles of the present invention installed therein and ready for operation to effect well cleaning, using a larger scale horizontally than vertically.

The method and apparatus of a presently preferred embodiment of the present invention employs a much simplified, inexpensive apparatus to create a wave of radially outwardly directed pressure within a section of well casing that is to be cleaned, and causes this pressure to travel longitudinally along the length of the casing. However, the power of such a pressure wave as provided from a length of unmodified detonator cord, for example, is sufficient to cause severe damage to the casing itself, if it is made strong enough to have any effect upon obstructions in the casing perforations. Therefore, according to a feature of the present invention, the pressure wave is suitably modified so as to provide a repetitive pressure action that is delayed, attenuated, or interrupted at certain points. More specifically, as the pressure wave travels along the length of the casing, its outward force is periodically attenuated, being restrained by microdelay devices in the form of high strength restrictor sleeves encircling the detonator cord. In effect, propagation of the pressure wave longitudinally of the well casing is repetitively delayed or interrupted. This operation is achieved by the relatively simple and inexpensive apparatus illustrated in the drawings.

FIG. 1 shows a three section length of well cleaning apparatus installed in a section of well casing 10 having a number of perforations 12 which are shown to be filled with debris or other obstructions indicated at 14. The purpose of the method and apparatus of the present invention is to provide a simple and inexpensive method for removing the obstructions 14 so as to clear the perforations without damage to the well casing. The drawing of FIG. 1 employs a larger scale horizontally than vertically, for clarity of illustration, and thus does not illustrate correct proportions. Exemplary proportions are specified below.

The apparatus includes three separate sections of pressure wave generating assemblies, 20, 22 and 24, respectively formed of flexible tubing sections 26, 28, 30, such as for example, extruded tubing of polyvinyl chloride filled with a combustible material 32, 34, 36 having a selected rate of deflagration. At present it is preferred to employ a standard detonating explosive known as PETN (Pentaerythritol Tetranitrate or Pentaerythrite Tetranitrate). In one form of the invention the outside diameter of the tubing sections 26,28,30 is approximately between 0.21 and 0.22 inches in diameter and the tubing has an inside diameter sufficient to provide a desired number of grains, such as for example, 20, 30, 40 or more grains per foot of length, depending upon the amount of power desired.

Figure 2:
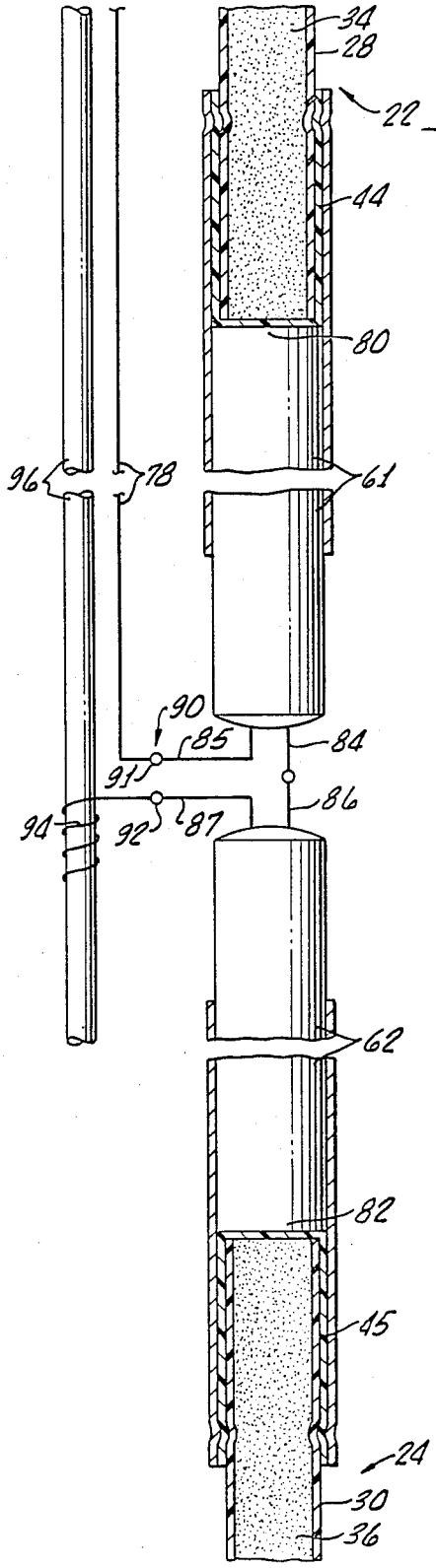
FIG. 2 is a showing of portions of the apparatus of FIG. 1 to a larger scale.
Figure 3:
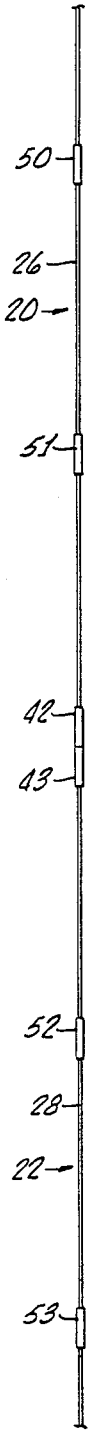
FIG. 3 shows portions of two sections of the apparatus to a smaller scale.

Each tube is closed and sealed at both ends with a closed cylindrical end cap, such as the metal caps 41 through 46, which are crimped to the exterior of the respective plastic tubes 26, 28 and 30, as best seen in FIG. 2.

Mounted on each of the plastic tubes, and longitudinally spaced from each other, are a plurality of microdelay devices in the form of high strength steel girdles or restrictor sleeves 50 through 55, which are crimped on the flexible tubes to hold them securely in place. The steel sleeves 50 through 55 are spaced from one another at suitable intervals. In a presently preferred embodiment, as an example, these intervals are between two and one-half and twenty-one feet, depending upon the length of the tube section, as will be described more particularly hereinafter. As presently preferred, the restrictor sleeves are made of a drawn seamless mild steel tubing, having a wall thickness in the range of about 1/32 to ¼ inches. Each sleeve has a length of about four inches in a presently preferred embodiment.

Detonator caps 60, 61 and 62, which are electrically activated, have metal connecting sleeves 65, 66 and 67 respectively fixed thereto as by a suitable adhesive, for example, at one end of the connecting sleeve and are crimped to respective end caps 41, 44 and 45 at the other end of the respective connecting sleeves.

Detonator cap 60 has a pair of electrical initiating leads 70,71 projecting from its initiating end and connected in series to connecting terminals 75,76 at a first electrical connecting point 72 formed between portions 77,78 of an electrical wire that extends along the length of the detonator tubes 20, 22 and 24. The firing end 80 of detonator 60 is positioned directly against end cap 41 to obtain through-the-bulkhead ignition and firing of the combustible material 32.

Detonator caps 61 and 62 are positioned back to back, in alignment with and interposed between adjacent ends of the lowermost two of the sealed tubes, tubes 22,24, with the firing end 80 of cap 61 positioned against end cap 44 and the firing end 82 of detonator cap 62 positioned against end cap 45 to provide through the bulkhead detonation of the combustible material in the detonator cords 22,24. Detonator cap 61 fires upwardly into tube 28, and detonator cap 62 fires downwardly into tube 30. Electrical lead 84 at the triggering end of detonator cap 61 is connected to corresponding electrical lead 86 at the closely adjacent triggering end of detonator cap 62. Leads 85 and 87 of the two detonator caps 61,62 are connected at a second connecting point 90 to the other end of wire 78 and to a second wire 94 which is grounded as by connection to a suspension cable 96. Cable 96, as seen in FIG. 1, is formed with a loop 97 from which a weight 98 is suspended to enable the apparatus to be positioned properly within the interior of the well casing.

The cable, the electrical wires 77, 78 and 94 and the pressure wave generating assemblies 20, 22 and 24 are all connected together by suitable means, such as a length of tape (not shown) spirally wound around the entire assembly for the full length thereof, thus securely coupling the several assemblies to the suspending cable. It may be noted that the drawings show the cable 26 and wire 78 laterally spaced from the pressure wave generating assemblies solely for clarity of illustration. In actual construction and operation these are closely joined to one another by the spirally wrapped tape.

For purposes of safety in handling and transport and to meet various governmental requirements, the detonator caps are not electrically or physically connected when the apparatus is initially assembled.

In manufacture of the described apparatus, the microdelay steel girdles 50 through 55 are initially located on the tubing sections and crimped in place. Thereafter the sealing end caps are positioned and crimped in place, and the tube sections are secured to the cable and wire by the spiral tape, leaving the adjacent ends of sections 22,24 and the upper end of section 20 free for subsequent connection of the detonator caps.

The detonator caps are prepared for handling and transport by securing the connecting sleeves 65, 66 and 67 thereto, but leaving the free projecting ends of the connecting sleeves unattached. Wires 70 and 71 of detonator 60 are connected to one another, and the similar pair of wires 84,85 of detonator cap 61 are connected together as are the wire pair 86,87 of detonator cap 82. This prevents accidental firing of the caps during handling and transportation. Connecting sleeves 66,67 are adhesively secured to the detonator caps 61,62 in the same manner as the sleeve 65 is secured to detonator cap 60. Thus the apparatus can be readily handled and transported in unarmed condition with the detonator caps effectively disabled and displaced from the relatively slower burning gas producing (explosive/-pyrotechnic) tubes.

For installation and operation in a well that is to be cleaned the detonator caps are assembled in the field, arming the apparatus, just prior to use, in the configuration shown in FIGS. 1 and 2. The wires of detonator cap 60 are disconnected from one another and connected to the electrical wires 77, 78 at connecting point 72. The sleeve secured to detonator cap 60 is placed over the end cap 41 and crimped thereto to securely position the detonator for through-the-bulkhead firing to fire downwardly into the uppermost end of tube 26.

Detonator caps 61 and 62 have their connecting sleeves 66 and 67 respectively placed over end caps 44 and 45 and are crimped thereto to fixedly secure these detonating caps in close back to back relation, with the firing end of detonating cap 61 pointing upwardly to fire through the end cap 44 into the combustible material 34 contained within tube 28. The firing end of detonator cap 62 is positioned against end cap 45 to enable this detonator cap to fire downwardly through the end cap 45 into the combustible material 36.

Ignitor wires 84 and 85 of detonator cap 61 are disconnected from one another as are the wires 86,87 of detonator cap 62. Wires 84 and 86 are then connected to each other, and wires 85,87 are connected to the adjoining ends of wires 78,94 at the lower connecting point 90. Thus a complete series circuit is formed to carry electrical power from wire 77 through the electrical activating end of detonator cap 60, thence through wire 78, through the electrical activating end of detonator 61, thence through the electrical activating end of detonator cap 62, and through wire 94 to the ground provided by cable 96. The arrangement of detonator caps simplifies and facilitates field installation and connection of the detonator caps and provides a desired location and sequence of the several series of pressure pulses.

After assembly of the three sections of tubing with the detonators positioned as described, the assembly is lowered by means of cable 96 (which extends well beyond the uppermost end of pressure wave generating assembly 20) until it is positioned in the selected section of a well casing that is to be cleaned. Electrical power is applied to the cable 77 and electrical activation of all of the detonator caps 60, 61 and 62 occurs simultaneously. However, the delay times of the several detonator caps are specifically chosen to provide a sequential triggering of the deflagration of the several bodies of combustible material in a selected sequence.

In a presently preferred embodiment the lowermost detonator cap 62 triggers its combustible material 36 first. Thereafter detonator cap 61 triggers material 34, and lastly detonator cap 60, the uppermost cap, triggers combustible material 32. The sequential triggering of the combustible material is afforded by the selective delays provided by the several detonators. Thus, in this presently preferred example, detonator cap 62 is made with a delay of approximately onè-half second. That is, one-half second after its electrical activation it will fire through the end cap 45 downwardly into the body of combustible material 36. Detonator cap 61 is provided with a delay of about two seconds, and thus initiates deflagration of combustible material 34 by firing upwardly through end cap 44 approximately one and one-half seconds after initiation of deflagration of the combustible material 36.

Detonator cap 60 is provided with a delay of about three and one-half seconds, and thus initiates deflagration of combustible material 32, by firing downwardly through end cap 41, approximately one and one-half seconds after initiation of deflagration of the intermediate body of combustible material 34. It will be understood that the actual and relative delay times set forth are only given by way of example, and other times may be used as deemed necessary or desirable.

The standard detonating explosive PETN employed as the combustible material has a deflagration rate of about 18,000 feet per second, and as its deflagration propagates from the initiating end longitudinally along the body of material within the casing, it creates a wave of radially outwardly directed pressure which also travels longitudinally along the casing. The small plastic tubes 26, 28, 30 provide almost no resistance to the outwardly directed pressure, but the microdelay devices formed by the high strength steel sleeves, such as sleeves 54,55 on tube 30, restrict the outwardly directed pressure and thus greatly attenuate the outwardly directed pressure of the explosive force at specific sections of tubing when the pressure wave has propagated along the tube to the position of the sleeves. In effect, propagation of the pressure wave longitudinally of the casing is momentarily delayed or interrupted by the presence of the high strength pressure attenuating sleeve, although, of course, the combustible material continues its deflagration rate along the entire length of the tube. Just past the end of the first restrictor sleeve, the nonattenuated pressure once again appears, and this wave of full pressure continues to propagate along the length ot the tube until it reaches the next microdelay sleeve, which again momentarily attenuates the pressure, interrupting propagation of the pressure wave, for the very short time required for the deflagration to propagate along the short length of the restrictor sleeve. Again, as the deflagration passes the end of the second restrictor sleeve, the outwardly directed pressure resumes its higher magnitude and continues at this maximum pressure to the end of the tube. Thus a series of mutually spaced (both physically and chronologically) pressure pulses is provided as the deflagration propagates along the length of the tube and is momentarily interrupted or attenuated by the restrictor sleeves.

After completion of the series of pressure pulses of the first detonated pressure generating assembly 24, the intermediate assembly 22 is detonated and provides a substantially identical series of pressure pulses operating in a manner identical to that described in connection with lowermost assembly 24, differing only in that the pressure wave propagates upwardly along tube 28, from lower end cap 44 to upper end cap 43, whereas for the tube 30 the pressure propagates downwardly from upper end cap 45 to lower end cap 46.

After completion of detonation of material 34 in tube 28, the last and uppermost assembly 20 begins its deflagration at its upper end cap 41, creating a series of pressure pulses that in effect move downwardly along the length of tube 26, just as previously described for tube 30. Thus the arrangement provides several (three in this illustrated embodiment) groups of pressure pulses, with each group initiated and completed prior to the initiation of the next group in the series. For each group a wave of outwardly directed pressure propagates along the length of a specific section of the casing within the casing and is momentarily attenuated at different times and different points in the course of its propagation.

The individual pressure wave generating assemblies, each composed of detonator cap, combustible material filled tube and restrictor sleeves are made in various lengths, depending upon the length of the well casing that is to be cleaned. For any one well cleaning device or tool, the lengths of all three pressure wave generating assemblies 20, 22 and 24 are the same. The total length of all three assemblies may vary from about 10 feet (where each assembly is approximately 3 feet long) to 200 feet (where each assembly is approximately 66 feet long) or more. The number and spacing of the microdelay restrictor sleeves varies with the length of the total assembly and the desired pulse effect. Thus, for example, in a 25 foot length, made of three sections connected as illustrated in FIG. 1, there will be six steel sleeves on each assembly. For each of the three tubes the sleeves are spaced at about two and one-half feet from each other and from the respective ends of the one tube. For a 50 foot total length (of three interconnected sections of tubing) each tube will have three restrictor sleeves equally spaced from each other and from the tube ends along the length of the one tube, making a total of nine sleeves for the three section length. Similarly for a 100 foot length, a total of twelve sleeves are used. For a 150 foot length eighteen sleeves are used, and for a 200 foot length, twenty-one sleeves are used, all equally spaced along the length of the three individual tubes which make up the three-section apparatus.

As previously mentioned, the inside diameter of the plastic tubes 26, 28 and 30 is varied to provide different amounts of the gas producing explosive. Where the cleaning is to be performed at a greater depth, and thus experiences greater water pressures for example, a larger inside diameter tube is employed to provide a more powerful, higher strength gas pressure.

Not only are the described method and apparatus easier and less costly to manufacture and more readily handled and installed than the apparatus described in U.S. Pat. No. 3,721,297, but, surprisingly and unexpectedly, it has been found in comparative tests that the apparatus described in the present application actually provides an improved cleaning operation. In a number of tests of the described apparatus no failures have been observed. Moreover, cleaning of a well with the apparatus and method described herein renews the well to enable it ot obtain 100% of its original capacity, whereas with the method previously employed, the average capacity of a well after cleaning is about 90% of its new capacity. The method and apparatus described herein not only provides an unexpected improvement in recovery of well capacity, but actually provides a more aesthetically pleasing appearance of the inside of the well, as viewed by the conventional down-hole television inspection device that is commonly employed before and after cleaning for inspection of effectivity of the operation.

It will be readily appreciated that the dimensions and numbers provided herein are set out for purposes of exposition and example only and that lengths, diameters, materials and numbers and sizes of restrictor sleeves, tube sections and other components may be readily varied without departing from principles of this invention.

Operation of the present apparatus and method is similar in many respects to operation of the arrangement described in U.S. Pat. No. 3,721,297, except that there is no explosive pulse preceding each group of pressure pulses. The pressure pulses of the apparatus and method described herein occur over a relatively greater length of detonator cord or deflagrating tube, and the restrictor sleeves also are of greater length than the neck-down or restricted conduits of the prior patent, thus providing somewhat longer duration pressure pulses separated by somewhat longer duration periods and lengths of attenuated pressure. The separate pressure pulses provide a surging action of liquid in the well which flows rapidly outwardly through casing apertures in response to the occurrence of a pressure pulse and surges rapidly back into the casing when the pressure wave is momentarily attenuated. Thus the method and apparatus provide a somewhat similar but significantly improved well cleaning operation, but at greatly reduced cost and effort of manufacture.

The foregoing detailed description is to be clearly understood as given by way of illustration and example only, the spirit and scope of this invention being limited solely by the appended claims.

What is claimed is:

1. Well cleaning apparatus for a liquid well having a casing comprising an elongated tube of substantially uniform cross section containing combustible material having a deflagration rate many times greater than the velocity of sound in the liquid of the well, means for igniting said combustible material to achieve deflagration of said material that progresses along the length of the tube and generates outwardly directed pressure, a plurality of short high strength sleeves mutually spaced by distances many times greater than the length of said sleeves secured to the exterior of said tube for attenuating said outwardly directed pressure at short areas spaced along the length of said tube by relatively long distances, and means for holding the tube in the casing of the well.

2. The well cleaning apparatus of claim 1 including second and third elongated tubes each containing combustible material, means for igniting the combustible material in said second and third tubes to achieve deflagration of the material in said second and third tubes that progresses along the length of said second and third tubes respectively and generates outwardly directed pressure, second and third restrictor means on the exteriors of said second and third tubes for attenuating said outwardly directed pressure generated upon deflagration of the material in said second and third tubes at at least one part of the length of each of said second and third tubes.

3. The well cleaning apparatus of claim 2 wherein said means for igniting comprise first, second and third electrically activated detonator caps, each connected to a respective one of said tubes at an end of such tube, each said detonator cap having a different amount of delay, whereby upon simultaneous electrical activation of all three of said detonator caps the combustible material of one of said tubes is ignited first, the combustible material of a second one of said tubes is ignited after ignition of the combustible material of said one tube, and the combustible material of the remaining tube is ignited after ignition of the combustible material of said second one of said tubes.

4. Well cleaning apparatus for a liquid well comprising an elongated tube containing a combustible material having a deflagration rate several times greater than the speed of sound in liquid of the well, means for igniting the combustible material at one end of said tube, a plurality of mutually longitudinally spaced high strength sleeves encircling and secured to the exterior of said tube at mutually spaced longitudinal locations therealong each said sleeve having a length considerably less than the length of said tube, each said sleeve being spaced from an adjacent sleeve by a distance significantly greater than the length of such adjacent sleeve, and means for positioning the tube in said well.

5. The apparatus of claim 4 including means for sealing ends of said tube comprising at least one sealing end cap positioned over an end of said tube and fixedly secured and sealed thereto, said means for igniting the combustible material comprising an electrically activated detonator cap having one end thereof abutting said sealing end cap, and a connector sleeve encircling one end of said detonator cap and said sealing end cap and secured thereto.

6. The apparatus of claim 4 including second and third elongated tubes each respectively containing second and third bodies of combustible material, second and third means for igniting said second and third bodies of combustible material, each of said second and third tubes having a plurality of high strength sleeves encircling and secured to such tube at positions mutually spaced along the length of such tube, all of said tubes being connected in end to end relation with one another.

7. The apparatus of claim 6 wherein said second and third means for igniting said second and third bodies of combustible material comprise first and second adjoining detonator caps interposed between adjacent ends of said second and third tubes, said first adjoining detonator cap having an end thereof in contact with an end of said second tube and said second adjoining detonator cap having an end thereof in contact with said third tube, each said detonator cap having a different delay time, and means for simultaneously electrically activating each of said detonator caps.

8. Well cleaning apparatus comprising first, second and third elongated tubes of substantially uniform diameter each containing respectively first, second and third bodies of high deflagration velocity combustible material, said tubes being positioned in substantial alignment with one another and in end to end relation, said first and second tubes having mutually adjacent ends, end caps secured to and sealing the interior of each end of each of said first, second and third tubes, first and second detonating caps positioned in back to back relation and interposed between said adjacent ends of said first and second tubes respectively, said first and second detonating caps having ends thereof in contact with said adjacent ends of said first and second tubes and being secured thereto, said second and third tubes being positioned with adjacent end caps and sealed ends thereof in substantial contact with one another, a third detonator having an end thereof in contact with an end cap of said third tube, a plurality of short, high strength, pressure attenuating sleeves encircling and secured to each of said tubes at portions of said tubes that are mutually longitudinally spaced from one another by distances many times greater than the length of said sleeves, there being at least two pressure attenuating sleeves encircling each tube, each of said detonator caps having a different delay time, means for activating each of said detonator caps, and a suspending cable secured to and extending along said tubes, whereby the cable and tubes may be positioned in the casing of a well to be cleaned.

9. The apparatus of claim 8 including first, second and third connecting sleeves respectively connecting said first, second and third detonators with respective ones of said first, second and third tubes.

10. A method of cleaning a casing of a fluid well comprising the steps of providing first, second and third tubes of detonator cord having a substantially uniform cross section filled with combustible material, forming a suspending cable and an electrically conductive wire extending along the length thereof, forming first and second pairs of series connection terminals on said wire at first and second mutually spaced electric connection points along said cable, positioning a plurality of short mutually spaced high strength sleeves on each of said first, second and third tubes at positions mutually spaced along the length of said tubes by distance greater than the length of said sleeves, sealing the ends of each of said tubes, securing said tubes in end to end relation to said cable and electrical wire with adjacent ends of said first and second tubes spaced apart by a selected distance near said first electric connection point of said cable and the remote-end of said third tube positioned near said second electric connection point, securing a first end of first, second and third connector sleeves, respectively, to first, second and third detonator caps, each said detonator cap having first and second electrical ignitor wires, securing the first and second ignitor wires of said first detonator to one another and securing the first and second ignitor wires of said second detonator to one another to prevent accidental detonation thereof, transporting said tubes, cable, wire and detonators with said detonators displaced from said tubes, positioning said detonators adjacent to and in contact with the ends of said first, second and third tubes with said first and second detonators being positioned between said first and second tubes, inserting adjacent ends of said first and second tubes into the other ends of said first and second connector sleeves with the ends of said tubes adjacent said first and second detonator caps respectively, securing said first and second connector sleeves to said first and second tubes respectively, inserting the end of said third tube into the other end of said third connector sleeve, and securing said third connector sleeve to said third connecting tube, connecting the first and second ignitor wires of said third detonator to said series connection terminals at said second connecting point, disconnecting said first and second wires of said first and second detonators from each other and connecting such first wires to said series connection terminals at said first connection point, connecting said second wires of said first and second detonators to each other, inserting said cable, electrical wire, tubes and detonators into a desired location within a well casing, and activating each of said detonators by electrically energizing said electrically conductive wire to thereby produce a series of outwardly directed pressure pulses within said well casing and effect cleaning of said casing.

11. Apparatus for cleaning the casing of a liquid well comprising a plurality of lengths of detonator cord, each comprising a length of tubing of uniform cross section filled with a detonating explosive having a rate of deflagration considerably greater than the velocity of sound in the liquid of the well, at least some of said detonator cord lengths having a plurality of relatively short high strength sleeves encircling and secured thereto, said sleeves being mutually spaced by distances at least several times greater than the length of each sleeve, means for connecting said lengths in end ot end relation, means for initiating deflagration of each of said lengths in succession, and means for positioning said connected lengths in the casing of a well to be cleaned.

12. The apparatus of claim 11 wherein said detonating explosive within each tube has a uniform cross section along the length of the tube, whereby upon detonation a wave of radially outward directed pressure is caused to propagate longitudinally within each tube at rates greater than the velocity of sound in the well liquid, and whereby said wave continues at full pressure along the major length of the tube and is attenuated by said sleeves at relatively short lengths of said tubes.

* * * * *